US008529020B2

(12) United States Patent
Goto

(10) Patent No.: US 8,529,020 B2
(45) Date of Patent: Sep. 10, 2013

(54) LIQUID DISCHARGE RECORDING HEAD

(75) Inventor: Ryohei Goto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 459 days.

(21) Appl. No.: 12/790,635

(22) Filed: May 28, 2010

(65) Prior Publication Data

US 2010/0309257 A1 Dec. 9, 2010

(30) Foreign Application Priority Data

Jun. 3, 2009 (JP) ..... 2009-134074
Mar. 26, 2010 (JP) ..... 2010-072951

(51) Int. Cl.
*B41J 2/14* (2006.01)
*B41J 2/16* (2006.01)
*B41J 2/15* (2006.01)
*B41J 2/145* (2006.01)

(52) U.S. Cl.
USPC ..... 347/50; 347/40

(58) Field of Classification Search
USPC ..... 347/40, 50
See application file for complete search history.

(56) References Cited

U.S. PATENT DOCUMENTS 7,188,925 B2 * 3/2007 Wood et al. ..... 347/20
7,240,991 B2 * 7/2007 Timm et al. ..... 347/50
2004/0001117 A1 * 1/2004 Choy et al. ..... 347/29

FOREIGN PATENT DOCUMENTS

JP 2007-296638 11/2007

* cited by examiner

*Primary Examiner* — Matthew Luu
*Assistant Examiner* — Renee I Wilson
(74) *Attorney, Agent, or Firm* — Canon USA Inc IP Division

(57) ABSTRACT

A liquid discharge recording head includes: a recording element substrate including a plurality of recording elements and discharge ports for discharging liquid; an electric wiring board including an opening for disposing the recording element substrate, and a plurality of electrode terminals disposed at an edge of the opening and electrically connected to a plurality of electrodes provided at an edge of the recording element substrate; a supporting plate supporting the recording element substrate and the electric wiring board and including a material having a linear expansion coefficient lower than the linear expansion coefficient of the electric wiring board; and a cover plate including a material having a linear expansion coefficient lower than the linear expansion coefficient of the electric wiring board, stacked on the electric wiring board on the supporting plate and fixed to both the supporting plate and the electric wiring board.

5 Claims, 9 Drawing Sheets

LIQUID DISCHARGE RECORDING HEAD

BACKGROUND OF THE INVENTION

1. Field of the Invention

The present invention relates to a liquid discharge recording head such as an ink jet recording head. Such a head is applied to a liquid discharge recording apparatus such as an ink jet recording apparatus performing recording operation by discharging liquid.

2. Description of the Related Art

Conventionally, the ink jet recording apparatus has relatively low running cost and can be downsized and further readily support color image recording using plural colors of inks. Accordingly, the apparatus has widely been used for a computer-related output apparatus and commercialized.

In recent years, it is desired that a recording head with the wide recording width in line recording in order to realize high resolution image recording at further high speed. More specifically, the recording head of 4 to 12 inches are required.

For example, Japanese Patent Application Laid-Open No. 2007-296638 discusses a recording head with a wide recording width. FIG. 10 illustrates an exploded perspective view of the recording head disclosed in Japanese Patent Application Laid-Open No. 2007-296638. In this recording head, a plurality of recording element substrates 1001 is arranged on a supporting plate 1200 in a staggered arrangement. An electric wiring board 1300 is disposed on the supporting plate 1200 and electrically connected to each recording element substrate 1001. Further, the supporting plate 1200 is connected to an ink supplying member 1500 and forms an ink jet recording head.

However, according to the recording head with such a configuration, the electric wiring board is formed from a resin film typically including polyimide; the linear expansion by heat, or the amount of expansion and contraction, is considerably larger than that of a supporting plate made from ceramic. A configuration where a metal plate including SUS is cemented on an electric wiring board is also disclosed. However, the difference of linear expansion is not well resolved; the expansion and contraction about three times that of supporting plate made of ceramic occurs. In general, the amount of expansion of a component under a temperature difference relates to the coefficient of linear expansion of the component×the difference of temperature×the length of component. Thus, the recording head with a wide recording width has significantly large electric wiring board (large in the longitudinal direction). This configuration considerably enlarges the difference in expansion and contraction by heat around the ends of the recording head.

Therefore, the amounts of change in dimension by heat particularly increase between the recording element substrates at the longitudinal ends of the recording head and the electric wiring board. Accordingly, large tensile and compression stresses are applied to a component (for example, Au wire) connecting the recording element substrate and electric wiring board. A problem may thus arise in terms of securing electric connectivity and reliability of electric connection.

SUMMARY OF THE INVENTION

The present invention is made in view of the problem of the conventional art. It is an object of the present invention to provide improved electric reliability of a recording head with a wide recording width.

In order to solve the problem described above, a liquid discharge recording head comprises: a recording element substrate including a plurality of recording elements and discharge ports for discharging liquid; an electric wiring board including an opening for disposing the recording element substrate, and a plurality of electrode terminals disposed at an edge of the opening and electrically connected to a plurality of electrodes provided at an edge of the recording element substrate; a supporting plate supporting the recording element substrate and the electric wiring board and including a material having a linear expansion coefficient lower than the linear expansion coefficient of the electric wiring board; and a cover plate including a material having a linear expansion coefficient lower than the linear expansion coefficient of the electric wiring board, stacked on the electric wiring board on the supporting plate and fixed to both the supporting plate and the electric wiring board.

The present invention can restrain variation in distance between the recording element substrate and the electric wiring board due to variation in temperature. As a result, electric reliability at longitudinal ends of the recording head with the wide recording width can be secured.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1A:
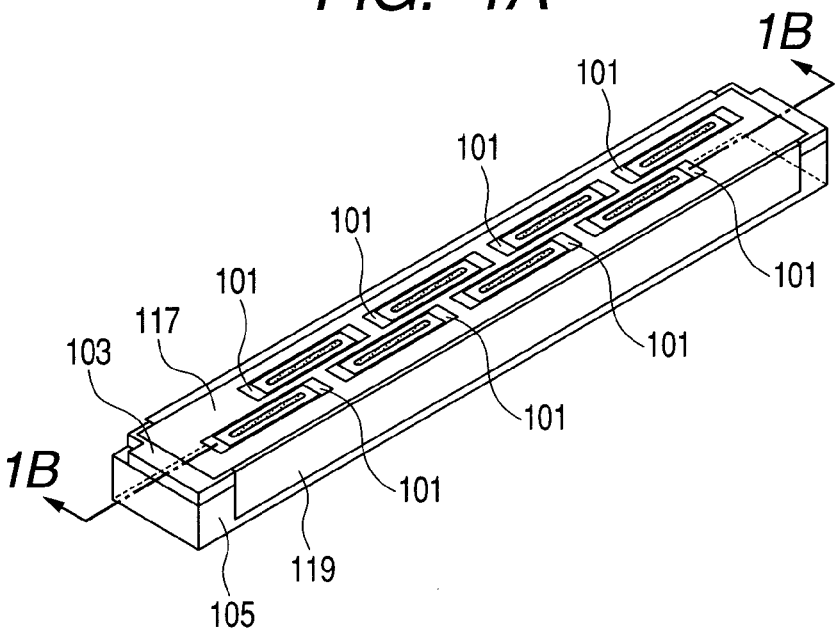
FIG. 1A is a perspective view illustrating a first exemplary embodiment of the present invention.

FIG. 1A is a perspective appearance view of an ink jet recording head illustrating this exemplary embodiment. FIG.

1B is a sectional view of the recording head taken along the line 1B-1B illustrated in FIG. 1A.

Figure 1B:
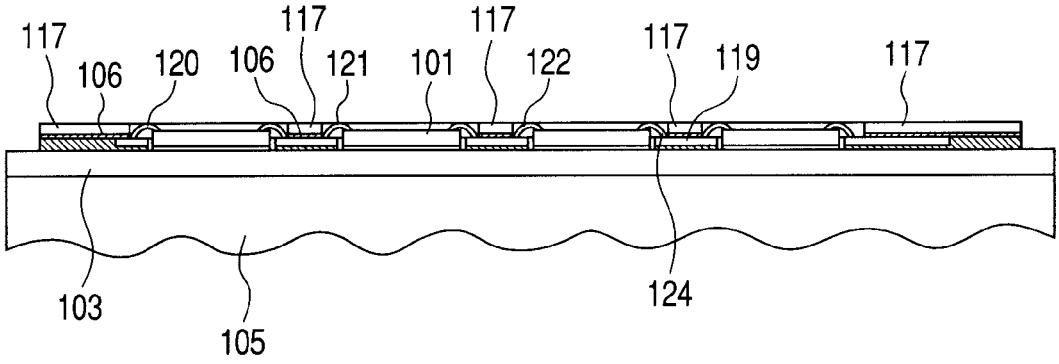
FIG. 1B is a sectional view taken along the line 1B-1B of FIG. 1A.

In FIGS. 1A and 1B, the ink jet recording head of this embodiment includes a plurality of recording element substrates 101 and an electric wiring board 119 for providing electric signals to the recording element substrates 101 from outside. Discharge energy generating elements 111 (see FIG. 2B) for discharging recording liquid are formed in the recording element substrate 101.

This ink jet recording head further includes a supporting plate 103 for fixedly supporting the recording element substrates 101 and the electric wiring board 119, and an ink supplying member 105 having a recording liquid supplying reservoir for storing the recording liquid to be supplied to each recording element substrate 101. The surface of the electric wiring board 119 on the supporting plate 103 is covered with a cover plate 117 for restraining deformation of the electric wiring board 119 due to variation in temperature.

The ink supplying member 105 and the supporting plate 103 are fixed by adhesive (not shown); the supporting plate 103 and each recording element substrate 101 are fixed by the adhesive. Further, the electric wiring board 119 and the cover plate 117 are fixed to supporting plate 103 by the adhesive 106. Likewise, the electric wiring board 119 and the cover plate 117 are also fixed by the adhesive 106.

Figure 2A:
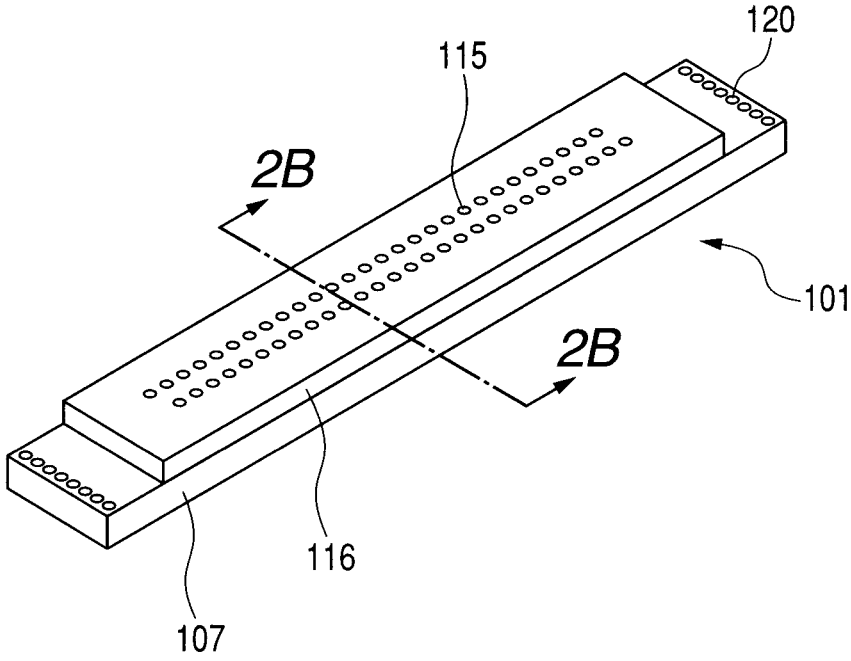
FIG. 2A is a perspective view of a recording element substrate used for the present invention.
Figure 2B:
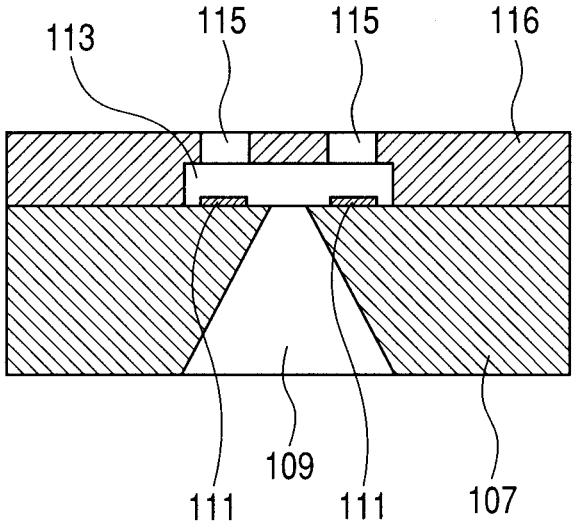
FIG. 2B is a sectional view taken along the line 2B-2B of FIG. 2A.

FIG. 2A is a perspective appearance view of the recording element substrate 101. FIG. 2B is a sectional view taken along the line 2B-2B illustrated in FIG. 2A. More specifically, the recording element substrate 101 includes a Si substrate 107, for example, formed from a thin film 0.5 to 1 mm thick. A recording liquid supplying port 109 is formed in the Si substrate 107 as an ink flow path; the port 109 is a through slot formed in a shape of a long groove. Electricity-heat transducing elements 111, which are discharge energy generating elements such as heaters, and electric wiring such as of Al are formed at both sides of the recording liquid supplying port 109 by a film formation technique. A flow path forming member 116 is formed on the Si substrate 107. A plurality of liquid discharge ports 115 is formed in the flow path forming member 116. The ports 115 correspond to the respective electricity-heat transducing elements 111 and are arranged in rows. Each liquid discharge port 115 communicates with the recording liquid supplying port 109 via a flow path 113.

Next, the configuration of the ink jet recording head of this embodiment will hereinafter be described.

The ink jet recording head of this embodiment includes a recording element unit and an ink supplying unit.

In the recording element unit, the eight recording element substrates 101 are arranged and fixed in a predetermined positional accuracy on the main surface of the supporting plate 103. The supporting plate 103 is, for example, made of alumina ($Al_2O_3$) material 0.5 to 10 mm thick. The material of the supporting plate 103 is not limited to alumina. Instead, the material may be what has a coefficient of linear expansion lower than that of the electric wiring board 119 and high stiffness. For example, the material may be silicon (Si), aluminum nitride (AlN), zirconia, silicon nitride ($Si_3N_4$), silicon carbide (SiC), molybdenum (Mo) and tungsten (W).

The plurality of recording element substrates 101, which mainly include silicon (Si) material, are arranged such that parts of the ends of groups of the discharge ports, which are provided on the respective recording element substrates 101 and form the rows, overlap each other in the discharge port arrangement direction. Accordingly, the groups of discharge ports corresponding to one row of the recording head of this embodiment are adapted such that the discharge ports of two rows of the recording element substrate 101 are arranged in the staggered arrangement. The parts of ends of discharge ports of the recording element substrates 101 are thus arranged in the overlapping manner. This configuration can thereby correct a malfunction concerning an image due to a positional deviation in arrangement.

Further, the electric wiring board 119, which is for providing electric inputs to the electricity-heat transducing elements 111 of the recording element substrate 101 from outside, is formed with openings corresponding to the fixed positions of the recording element substrates 101. The recording element substrate 101 is cemented to the supporting plate 103 so as to fit into the opening. As shown in FIGS. 1B and 2A, electrodes 120 formed on the ends of the surface of the recording element substrate 101 and the electrode terminal 124 formed on the surface of the electric wiring board 119, are connected to each other by an electrically connecting part such as bonding wire 121. The electrically connecting part is sealed with a sealing agent 122 in order to prevent corrosion owing to recording liquid.

As shown in FIGS. 1A and 1B, the ink supplying unit includes the ink supplying member 105, a filter (not shown), a joint rubber (not shown) and a flow path plate (not shown). More specifically, the ink supplying member 105 is formed from a structural base member by injection molding using resin material.

Here, the cover plate 117 according to this embodiment has a longitudinal dimension longer than that of the electric wiring board 119 and a thickness of 0.1 to 0.3 mm. The cover plate 117 is formed from a Ti material ($\alpha$=5 ppm/° C.) whose coefficient of linear expansion is smaller than that of the electric wiring board 119. Such a cover plate 117 is cemented to the electric wiring board 119 so as to cover the entire top part of the electric wiring board 119. Here, as shown in FIG. 1A, the cover plate 117 and the supporting plate 103 are directly cemented to the recording head at both the longitudinal ends thereof.

According to this configuration, the electric wiring board 119 is cemented between the supporting plate 103 of alumina and the cover plate 117 of Ti, whose linear expansion coefficients are smaller than that of the electric wiring board 119. The expansion and contraction of the electric wiring board 119 due to variation in temperature is restrained to those of the material having a small linear expansion coefficient. In particular, with respect to electricity, it can be adapted such that the cover plate 117 and the supporting plate 103 are cemented to the recording head at both longitudinal ends thereof while sandwiching the wiring element, as with this embodiment. This configuration can restrain the expansion and contraction of the electric wiring board at the around both the longitudinal ends of the recording head which the expansion of the electric wiring board significantly affects.

The recording head of this embodiment and reference recording heads as comparative examples have been made. The length of the electrically connecting part at the end of each recording head has been measured. Three reference recording heads have been made. That is, three heads modified as follows have been prepared with respect to the recording head of this embodiment: (1) the recording head without the cover plate 117; (2) the recording head with the cover plate 117 which has been made of Ti but not cemented to the supporting plate 103; (3) the recording head with the cover plate 117 which has been made of polyimide ($\alpha \cong 20$ ppm/° C.) and cemented to both of the electric wiring board 119 and the supporting plate 103.

Figure 3A:
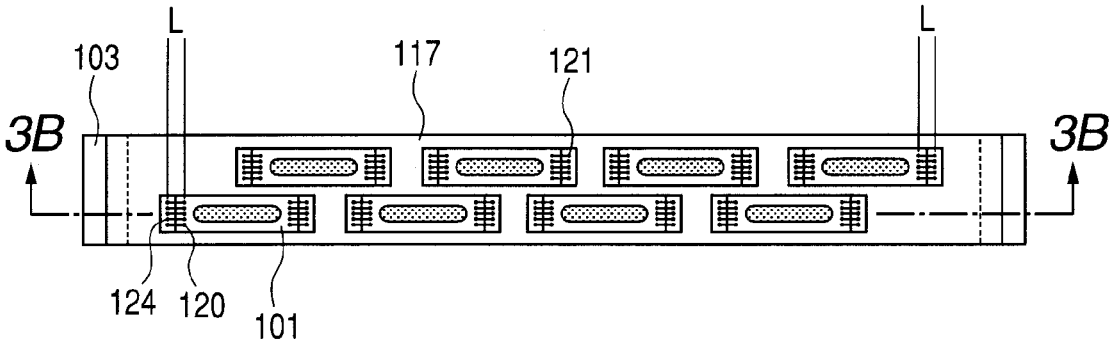
FIG. 3A is a front view of the first exemplary embodiment of the present invention.
Figure 3B:
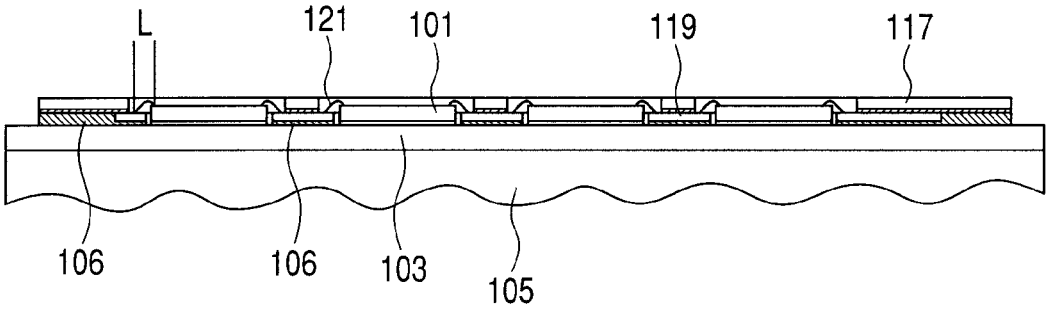
FIG. 3B is a sectional view taken along the line 3B-3B of FIG. 3A.
Figure 4A:
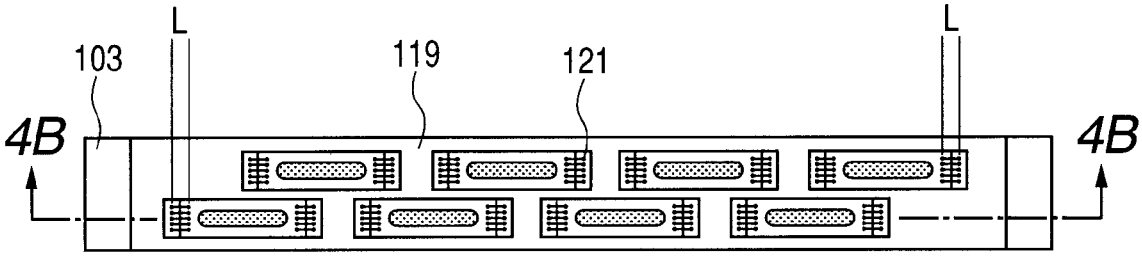
FIG. 4A is a front view of a reference head (1) for comparison with a recording head of the first exemplary embodiment.
Figure 4B:
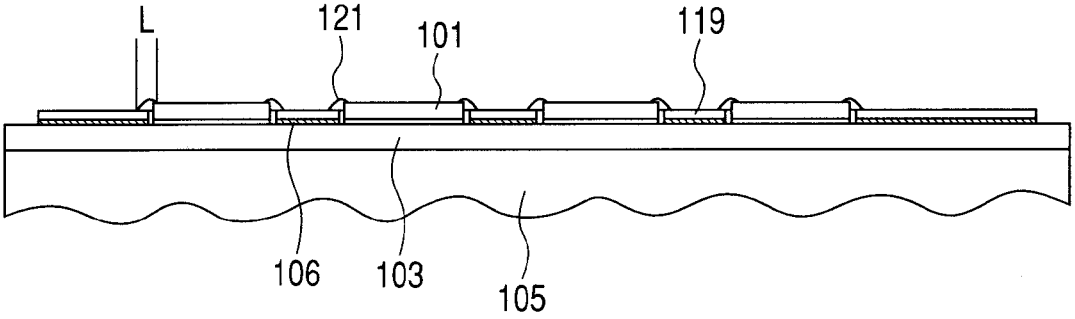
FIG. 4B is a sectional view taken along the line 4B-4B of FIG. 4A.
Figure 5A:
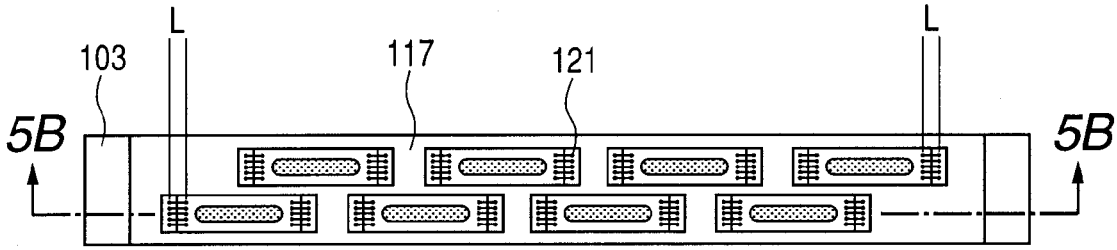
FIG. 5A is a front view of a reference head (2) for comparison with the recording head of the first exemplary embodiment.
Figure 5B:
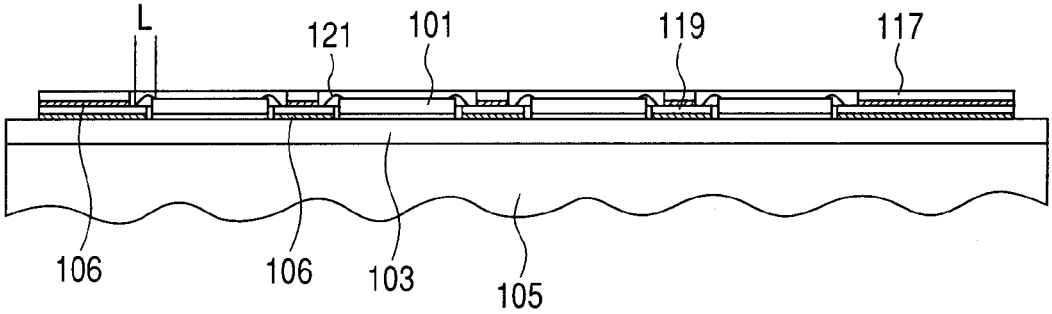
FIG. 5B is a sectional view taken along the line 5B-5B of FIG. 5A.
Figure 6A:
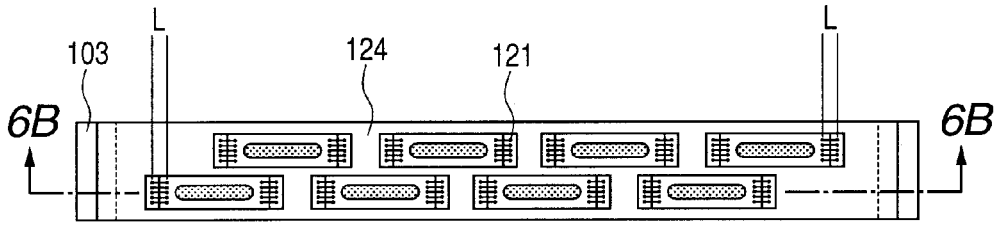
FIG. 6A is a front view of a reference head (3) for comparison with the recording head of the first exemplary embodiment.
Figure 6B:
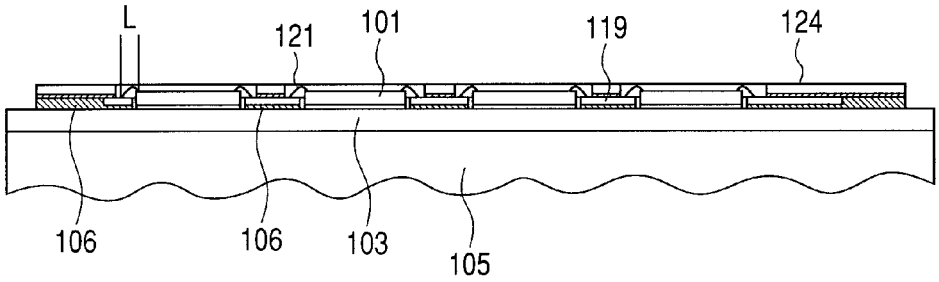
FIG. 6B is a sectional view taken along the line 6B-6B of FIG. 6A.

FIG. 3A is a front view of the recording head of this embodiment; FIG. 3B is a sectional view taken along the line 3B-3B of FIG. 3A. Front views of the reference recording heads (1) to (3) are illustrated in FIGS. 4A, 5A and 6A; sectional views thereof taken along the lines 4B-4B, 5B-5B and 6B-6B are illustrated in FIGS. 4B, 5B and 6B, respectively.

Each recording head to be measured includes the supporting plate 103 of alumina (183 mm wide in longitudinal dimension) and the electric wiring board 119 of flexible film wiring board (161 mm wide in longitudinal dimension). The supporting plate 103 and the electric wiring board 119 are cemented by a thermosetting epoxy resin 106 (about 50-100 μm thick). The longitudinal dimension width of the cover plate 117 of this embodiment is 171 mm; the longitudinal dimension width of the recording head (2) is 161 mm; and longitudinal dimension width of the recording head (3) is 171 mm. As well as the recording heads, the supporting plates 103 and the electric wiring boards 119 are cemented by the thermosetting epoxy resin 106.

The measurement temperature was an ambient temperature (23° C.) and a high-temperature environment (150° C.). The lengths L of electric wiring parts at the ends of the recording heads have been measured at both the temperatures. The electric wiring part indicates a part between an electrode formed at the end of the surface of the recording element substrate 101 and an electrode terminal formed at the surface of the electric wiring board 119 (FIG. 3B).

Table 1 represents the results of the respective types of recording heads. These results show that the expansion and contraction of the electric wiring board of this embodiment has been restrained. Therefore, according to this embodiment, the amount of distance variation owing to temperatures between the recording element substrate 101 and the electric wiring board 119 can be restrained; the recording head having high electric reliability can be obtained.

TABLE 1

| | HEAD TYPE | | | |
|---|---|---|---|---|
| | RECORDING HEAD OF THIS EMBODIMENT | REFERENCE RECORDING HEAD (1) | REFERENCE RECORDING HEAD (2) | REFERENCE RECORDING HEAD (3) |
| VARIATION AMOUNT OF L/μm | 8 | 25 | 25 | 27 |

Although this embodiment has been described such that the material of the cover plate 117 is Ti, the material is not limited to Ti. Instead, any material having a low coefficient of linear expansion may be applied. For example, ceramic and metal materials, such as alumina ($Al_2O_3$), silicon (Si), aluminum nitride (AlN), zirconia, silicon nitride ($Si_3N_4$), silicon carbide (SiC), molybdenum (Mo) and tungsten (W), may be adopted. That is, the linear expansion coefficients of the cover plate 117 and the supporting plate 103 can be lower than the linear expansion coefficient of the electric wiring board 119. A large difference between the linear expansion coefficients of the cover plate 117 and the supporting plate 103 creates distortion, thereby causing possibility of exerting an influence on the electrically connecting part. Accordingly, a configuration can be selected where the linear expansion coefficients of the cover plate 117 and the supporting plate 103 are substantially the same as each other.

Figure 7:
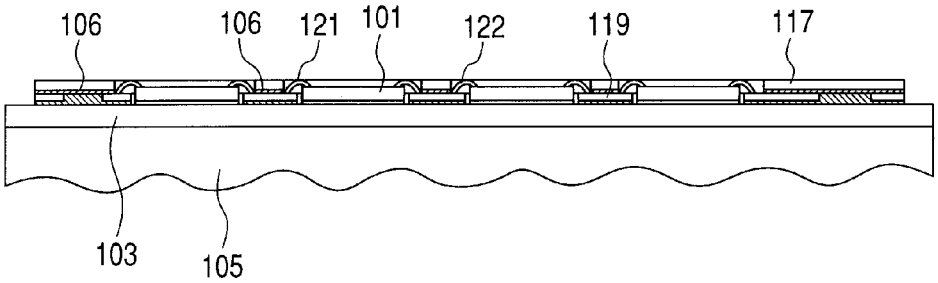
FIG. 7 is a sectional view illustrating a modification of the first exemplary embodiment.

As to the fixation by cementing between the cover plate 117 and the supporting plate 103 at the longitudinal end of the recording head, the longitudinal dimensions of the cover plate 117 and the electric wiring board 119 can be the same as each other, as shown in FIG. 7. In this case, the electric wiring board 119 is provided with an opening at an area in proximity to the longitudinal end of the recording head. The cover plate 117 and the supporting plate 103 are cemented to each other through the opening. This configuration can maintain flatness over the entire area of the cover plate 117.

A second exemplary embodiment of the present invention will be described with reference to FIGS. 8A and 8B.

Figure 8A:
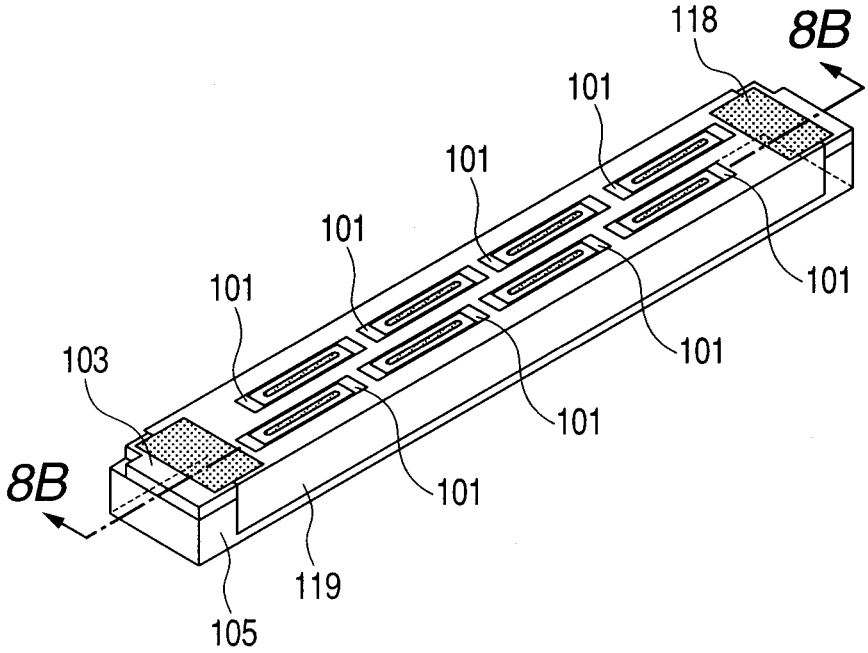
FIG. 8A is a perspective view of a second exemplary embodiment of the present invention.

FIG. 8A illustrates an ink jet recording head pertaining to the second exemplary embodiment of the present invention; FIG. 8B is a corresponding sectional view taken along the line 8B-8B of FIG. 8A. As to elements which can be configured as with the first exemplary embodiment, identical symbols will be assigned to the corresponding parts and description thereof will be omitted.

In this embodiment, the cover plate is disposed only in proximity to a longitudinal end of the recording head.

Figure 8B:
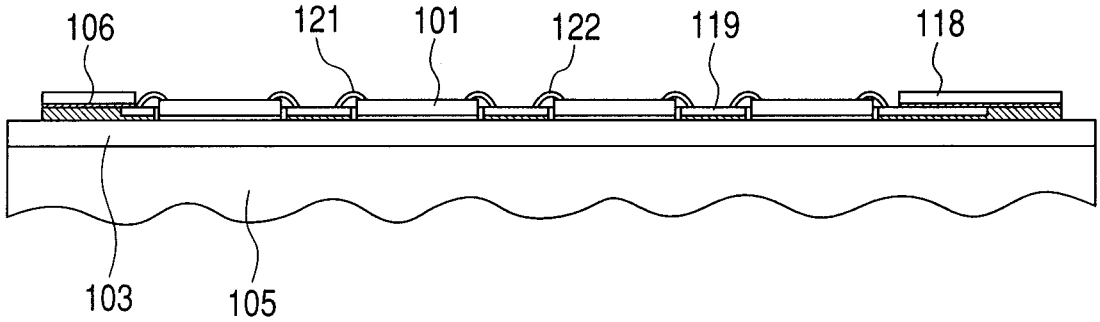
FIG. 8B is a sectional view taken along the line 8B-8B of FIG. 8A.

As shown in FIGS. 8A and 8B, in this embodiment, the cover plate 118 is smaller than that in the first exemplary embodiment and disposed in the proximities of each end of the electric wiring board 119. Further, the cover plate 118 is cemented to the top surface of the electric wiring board 119 and the supporting plate 103.

In general, a plane including the surface (surface where the discharge port is formed) of the recording element substrate 101 is periodically cleaned by wiping with a rubber blade for the sake of secure recording without a deterioration of the recording quality in the ink jet recording head.

In the present invention, the cover plate is formed from a ceramic or a metallic material having a linear expansion coefficient lower than the linear expansion coefficient of the electric wiring board 119. Accordingly, it is concerned that the rubber blade is damaged or deteriorates in durability at the cleaning process.

In this case, it is effective to adopt a configuration without cover plate in the wiping area, as with this embodiment.

Thus, in this embodiment, the cover plate 118 is partially disposed at the longitudinal end of the recording head. Accordingly, the configuration, where the cover plate 118 is not wiped when the surface of the recording element substrate is wiped, can be adopted. This configuration can also restrain the expansion and contraction of the wiring board as with the above embodiment. Therefore, the reliability of electric connection can be improved between the recording element substrate and the electric wiring board.

In this embodiment, the cover plate 118 and the supporting plate 103 are not cemented at both widthwise ends of the recording head. This configuration can relieve stress generated at the electric wiring board under heating, into the widthwise direction of the recording head. The amount of expansion in the widthwise direction of the recording head is small. Accordingly, an influence thereof on the electrically connecting part is also small.

If the cover plate 118 and the supporting plate 103 are cemented to each other all around the edges without any allowance, the stress to be generated under heating cannot be relieved into anywhere, thereby causing possibility of peeling the cemented fixation. The configuration of this embodiment can relieve the stress without any influence on the electrically connecting part.

A third exemplary embodiment of the present invention will be described with reference to FIGS. 9A and 9B.

Figure 9A:
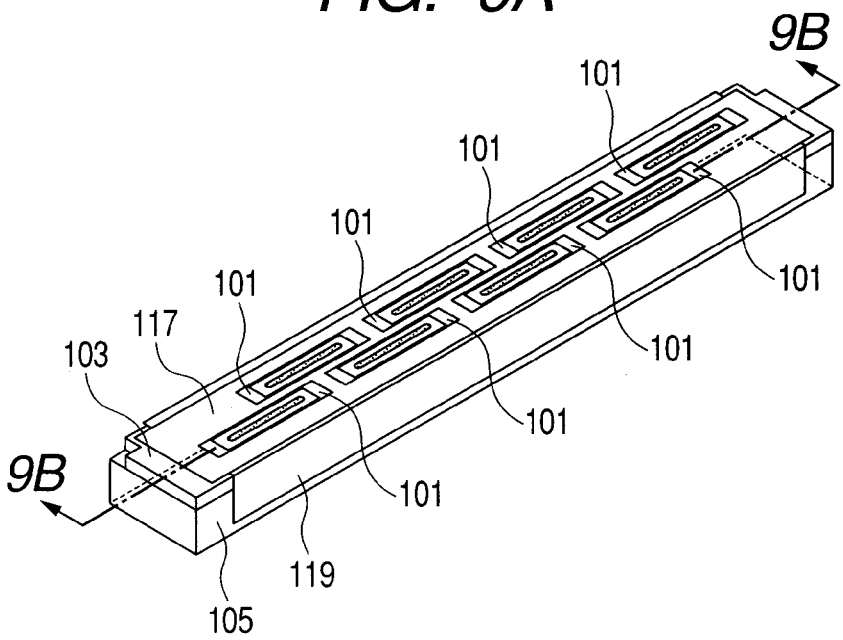
FIG. 9A is a perspective view of a third exemplary embodiment of the present invention.
Figure 9B:
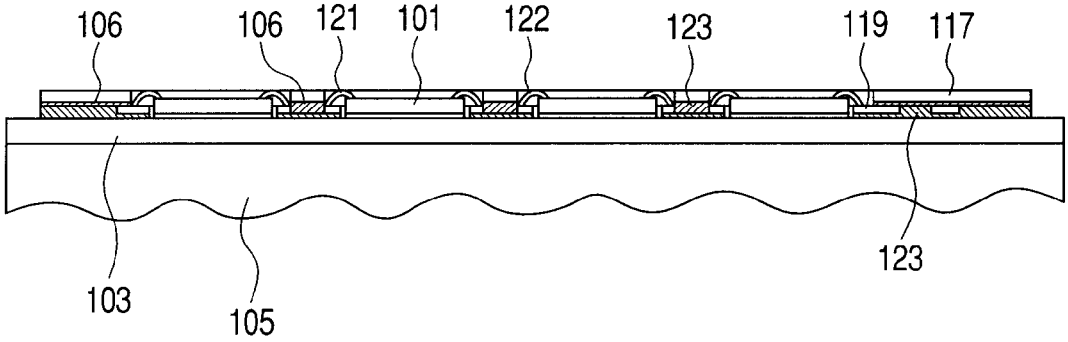
FIG. 9B is a sectional view taken along the line 9B-9B of FIG. 9A.
Figure 10:
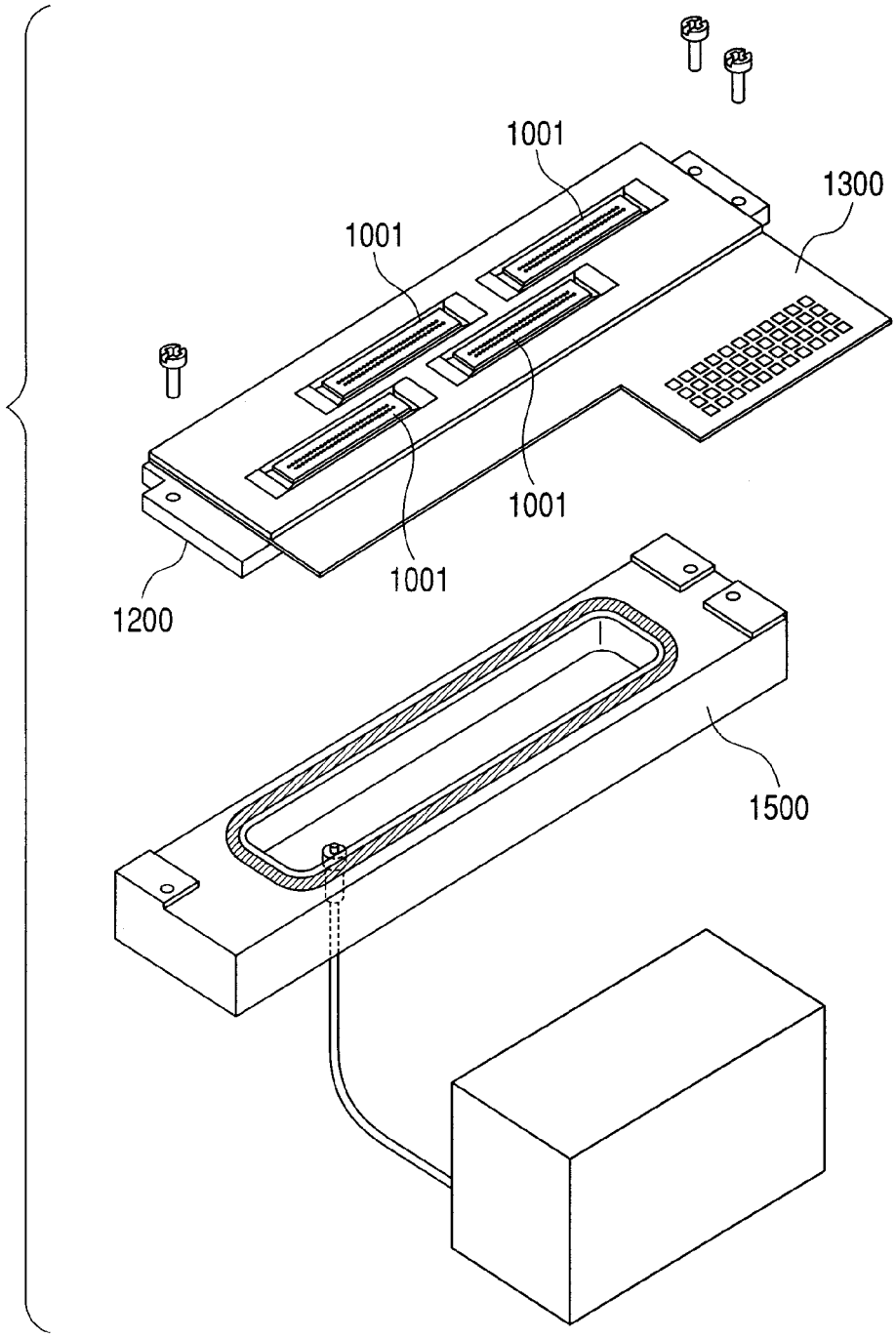
FIG. 10 is an exploded perspective view of a recording head disclosed in Japanese Patent Application Laid-Open No. 2007-296638.

FIG. 9A illustrates an ink jet recording head pertaining to the third exemplary embodiment of the present invention; FIG. 9B is a corresponding sectional view taken along the line 9B-9B of FIG. 9A. As to elements which can be configured as with the first exemplary embodiment, identical symbols will be assigned to the corresponding parts and description thereof will be omitted.

This embodiment adopts a configuration where the cover plate and the supporting plate are cemented to each other not only at both the ends of the recording head, but also through openings provided in the electric wiring board separately from the openings for arranging the recording element substrates.

As shown in FIG. 9, as with the first exemplary embodiment, the cover plate 117 and the electric wiring board 119 are cemented to each other. The cover plate 117 and the supporting plate 103 are directly cemented to each other at both the longitudinal ends of the recording head. In particular, according to this embodiment, some areas without disposition of wiring are formed in the electric wiring board 119. The openings 123 are formed in these areas.

The number, positions and dimensions of openings 123 are arbitrarily determined according to the wiring pattern and the dimension and length of the electric wiring board. The cover plate 117 and the supporting plate 103 are directly cemented through the openings 123. The cover plate 118 and the supporting plate 103 are thus intermittently fixed along the widthwise edges of the recording head. This configuration can thereby provide paths for relieving the stress, as with the descriptions of the above embodiments.

Therefore, in this embodiment, the cemented fixation area between the cover plate 117 and the supporting plate 103 is larger than that of the first embodiment. Accordingly, the expansion and contraction of the electric wiring board 119 is further restrained, thereby allowing reliability to be improved in electric connection between the recording element substrate 101 and the electric wiring board 119.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2009-134074, filed on Jun. 3, 2009, and 2010-072951, filed on Mar. 26, 2010, which are hereby incorporated by reference herein in their entirety.

What is claimed is:

1. A liquid discharge recording head comprising:

a recording element substrate including a plurality of recording elements and discharge ports for discharging liquid;

an electric wiring board including an opening for disposing the recording element substrate, and a plurality of electrode terminals disposed at an edge of the opening and electrically connected to a plurality of electrodes provided at the recording element substrate;

a supporting plate supporting the recording element substrate and the electric wiring board and including a material having a linear expansion coefficient lower than the linear expansion coefficient of the electric wiring board; and a cover plate including a material having a linear expansion coefficient lower than the linear expansion coefficient of the electric wiring board, stacked on the electric wiring board on the supporting plate and fixed to both the supporting plate and the electric wiring board by an adhesive.

2. The liquid discharge recording head according to claim 1, wherein the cover plate and the supporting plate are fixed at least at both longitudinal ends of the liquid discharge recording head.

3. The liquid discharge recording head according to claim 2, wherein the cover plate and the supporting plate are fixed using a plurality of openings provided separately from the opening in the electric wiring board.

4. The liquid discharge recording head according to claim 3, wherein the plurality of openings provided separately from the opening are provided at both widthwise ends of the liquid discharge recording head.

5. The liquid discharge recording head according to claim 2, wherein the cover plate and the supporting plate are not fixed at either widthwise end of the liquid discharge recording head.

* * * * *